US007482901B2

(12) United States Patent
Watanabe et al.

(10) Patent No.: US 7,482,901 B2
(45) Date of Patent: Jan. 27, 2009

(54) CIRCUIT BREAKER

(75) Inventors: Kazumasa Watanabe, Tokyo (JP); Hiroyuki Kakisako, Tokyo (JP); Shigeki Koumoto, Tokyo (JP); Takashi Iitsuka, Tokyo (JP); Kouzou Maeta, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 105 days.

(21) Appl. No.: 11/448,710

(22) Filed: Jun. 8, 2006

(65) Prior Publication Data

US 2007/0139147 A1 Jun. 21, 2007

(30) Foreign Application Priority Data

Dec. 21, 2005 (JP) ..... P2005-368020

(51) Int. Cl.
*H01H 9/30* (2006.01)

(52) U.S. Cl. ..... 335/201; 335/14; 335/103; 335/106; 335/132; 335/156; 335/202

(58) Field of Classification Search ..... 335/14, 335/103, 106, 132, 156, 201–202
See application file for complete search history.

(56) References Cited

U.S. PATENT DOCUMENTS 3,354,415 A * 11/1967 Gribble et al. ..... 335/131
6,373,014 B1 * 4/2002 Mitsuhashi et al. ..... 218/22
6,573,815 B1 * 6/2003 Tsukima et al. ..... 335/202
7,154,062 B2 * 12/2006 Asakawa et al. ..... 218/155

FOREIGN PATENT DOCUMENTS

JP 2005-228669 8/2005

* cited by examiner

*Primary Examiner*—Elvin G Enad
*Assistant Examiner*—Mohamad A Musleh
(74) *Attorney, Agent, or Firm*—Sughrue Mion, PLLC

(57) ABSTRACT

A circuit breaker is comprised of a make-and-break mechanism part disposed between frame plates opposite to each other; a base in which a breaking portion including cross bar, moving contact, fixed contact and arc-extinguishing device, and an over-current trip device are contained; a middle base, in which a partition wall separating the breaking portion from the make-and-break mechanism part, and the breaking portion from the over-current trip device, is provided; and a cover for covering the base and middle base. A frame of the make-and-break mechanism part is secured to the base through the middle base, and the secured part of the frame and the inner bottom face of the base are disposed in the proximity.

10 Claims, 8 Drawing Sheets

CIRCUIT BREAKER

BACKGROUND OF THE INVENTION

1. Field of the Invention

The present invention relates to a circuit breaker such as no-fuse circuit breakers or earth leakage breakers and, more particularly, to a circuit breaker of which specification can be easily changed depending on breaking capacity.

2. Description of the Related Art

A circuit breaker not only has the function of make-and-break of an electric circuit, i.e., the switch function by the operation of an operating handle provided at this circuit breaker, but also has the function of breaking an electric circuit for preventing electric wires or current consumers from burning due to the flow of an over-current, i.e., an important role of breaking function. This breaking of an electric circuit is defined to be within a range of 1 kA to 200 kA as "rated breaking current" in accordance with, for example, JIS (Japanese Industrial Standard) C8370. It is as known that each manufacturer intends to provide a wide range of product variations so as to select a circuit breaker having a suitable rated breaking current depending on situations of the electric circuit, that is, distance from a transformer, or thickness of an electric wire.

At the time of breaking an electric circuit in such a circuit breaker, molten metallic materials or molten insulating materials due to the generation of arc heat may be scattered in the surrounding area along with arc gas, and the molten materials may be adhered to the make-and-break mechanism or the trip mechanism. In general, a circuit breaker is capable of interrupting a rated breaking current about two to three times. Further, when considering that the rapid reset operation (sliding shift to the OFF position of an operating handle) is made, for example, to stop an alarm output having been generated at the time of breaking, it is not desirable that functions of the above-mentioned make-and-break mechanism or trip mechanism are impaired due to adhesion of the above-mentioned molten materials.

To address such problems, conventionally, as shown in the Japanese Patent Publication (unexamined) No. 228669/2005, the following circuit breaker is proposed. This circuit breaker is arranged such that an insulating housing of the circuit breaker is divided into a case body, a middle cover to be mounted on the top of this case body, and a top cover with which the top of the middle cover is covered; a contact portion where arc is generated and an arc-extinguishing device functioning to extinguish this arc, are contained in the case body; and a make-and-break mechanism or a trip mechanism is contained in the middle cover to separate the above-mentioned make-and-break mechanism or trip mechanism from the contact portion, thereby preventing the adhesion of molten materials to, e.g., make-and-break mechanism.

However, in the circuit breaker as shown in the above-mentioned Japanese Patent Publication (unexamined) No. 228669/2005, due to the fact that a partition wall over each of the poles is formed at the bottom of the middle cover and a make-and-break mechanism or a trip mechanism is attached to a central pole portion of the above-mentioned partition wall, a middle cover will be inevitably an indispensable part to construct a circuit breaker. Since there are varieties of rated breaking currents respectively serving as indexes of performance capability of a circuit breaker as described above, there is no reason that a circuit breaker should have a large rated breaking current. Rather, it is preferable to select a rated breaking current in light of situations of an electric circuit thereof.

Nevertheless, in the case of a comparatively small rated breaking current, the adhesion of molten materials is not regarded as a disadvantage, so that the mounting of a middle cover is an over specification, and there will be the possibility of being less cost competitive.

Furthermore, in the case of preparing a circuit breaker without the use of the middle cover in order to prevent the over specification, it is necessary to review the entire construction of a make-and-break mechanism itself. Thus, a problem exists in that it is difficult to share parts depending on the magnitude of rated breaking current, that is, the difference in breaking capacity.

SUMMARY OF THE INVENTION

The present invention was made to solve the problems as described above, and has an object of obtaining a circuit breaker in which a breaking portion and a make-and-break mechanism part, and a breaking portion and an over-current trip device are separated as has heretofore been done in the case of a comparatively large rated breaking current, and in which they are not separated without change of layout or part structure of these breaking portion, make-and-break mechanism part, and over-current trip device in the case of a comparatively small rated breaking current.

A circuit breaker according to the invention comprises:

a make-and-break mechanism part that includes an operating handle, and is disposed between frame plates opposite to each other;

a base in which a cross bar that turns in cooperation with mentioned make-and-break mechanism part, a moving contact that cooperates with the cross bar, a fixed contact that repeats contact and separation from the moving contact, a breaking portion including an arc-extinguishing device functioning to extinguish arc generated between both contacts, and an over-current trip device are contained;

a middle base in which a partition wall serving to separate the mentioned breaking portion from the make-and-break mechanism part, and the mentioned breaking portion from the over-current trip device, is provided; and in which the mentioned make-and-break mechanism part is contained; and a cover with which mentioned base, middle base and each of parts contained in these base and middle base are covered.

In this circuit breaker, a frame of the mentioned make-and-break mechanism part is secured to the mentioned base through the mentioned middle base; and the secured part of the mentioned frame and the inner bottom face of the mentioned base are disposed in the proximity.

The circuit breaker of above construction may comply with both of the mentioned specification of separating the above-mentioned make-and-break mechanism or trip mechanism from the above-mentioned breaking portion, and the specification of no such separation. Thus, irrespective of the magnitude of breaking capacity, or even if there is any difference in the rated current value or the number of poles, it comes to be possible to share main components of the circuit breaker such as make-and-break mechanism part. Consequently, it is possible to achieve the cost down of products.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiment 1

Figure 1:
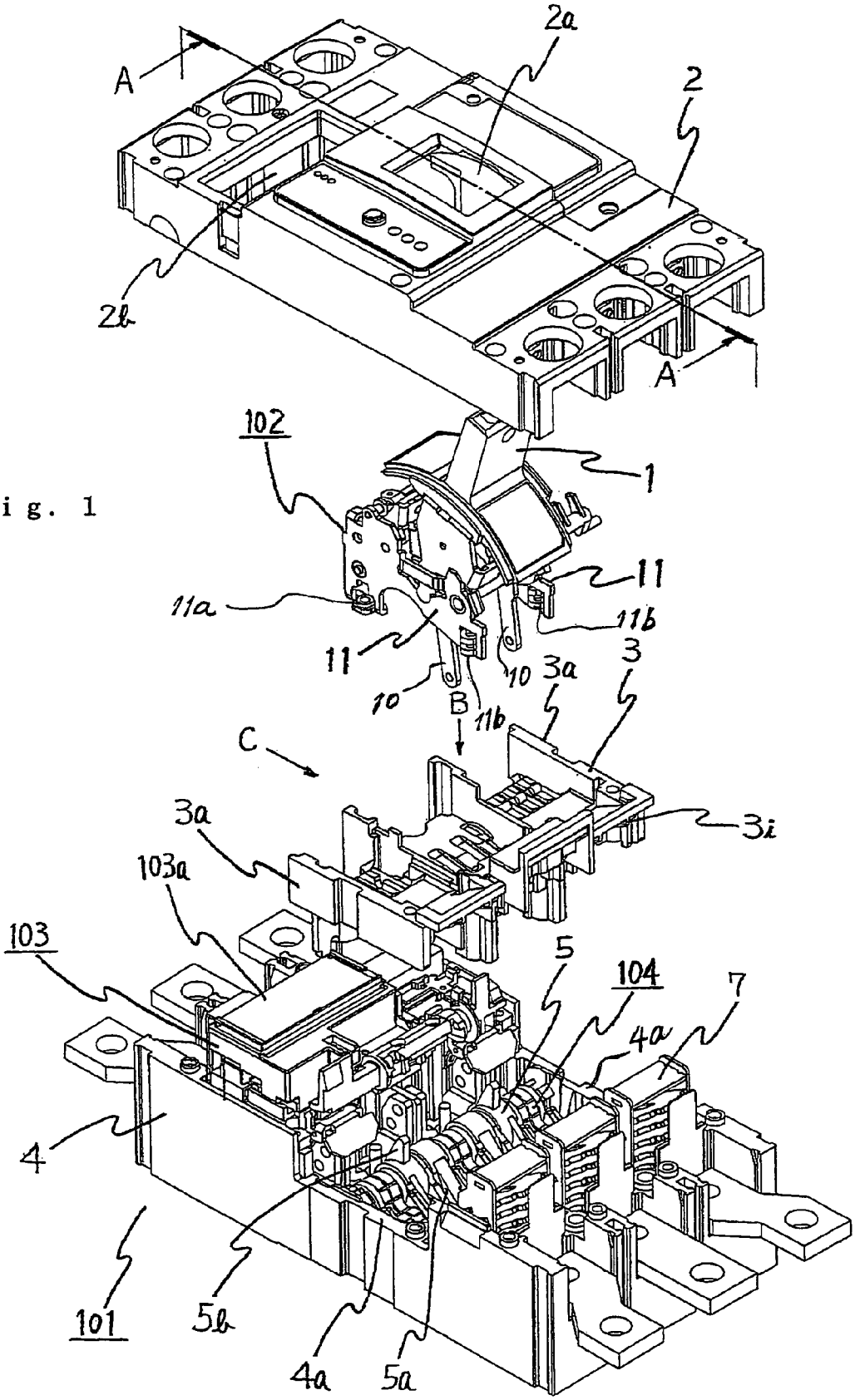
FIG. 1 is an exploded perspective view of a circuit breaker according to a first preferred embodiment of the present invention.
Figure 2:
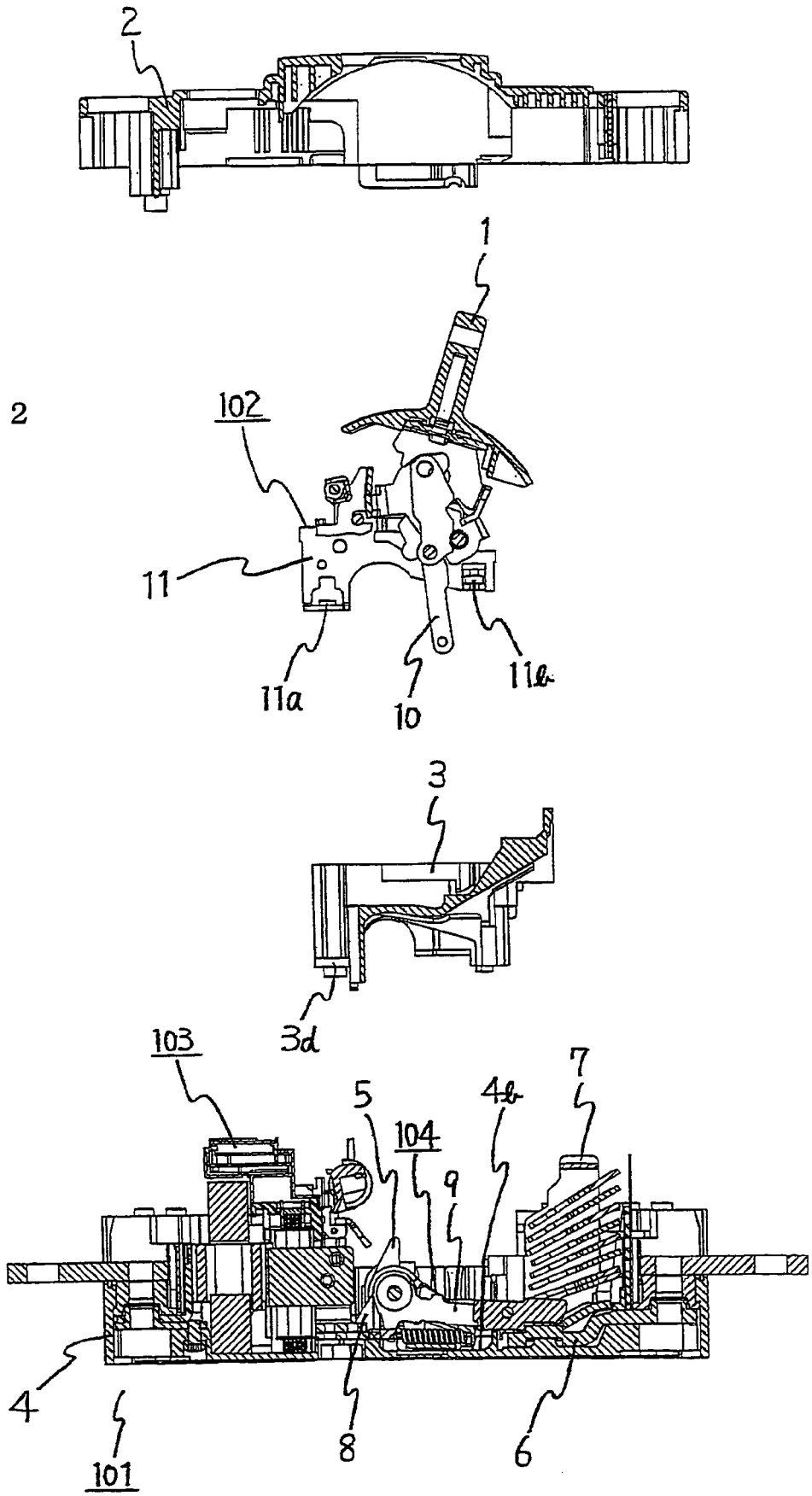
FIG. 2 is cross sectional view taken along the line A-A in FIG. 1.
Figure 3:
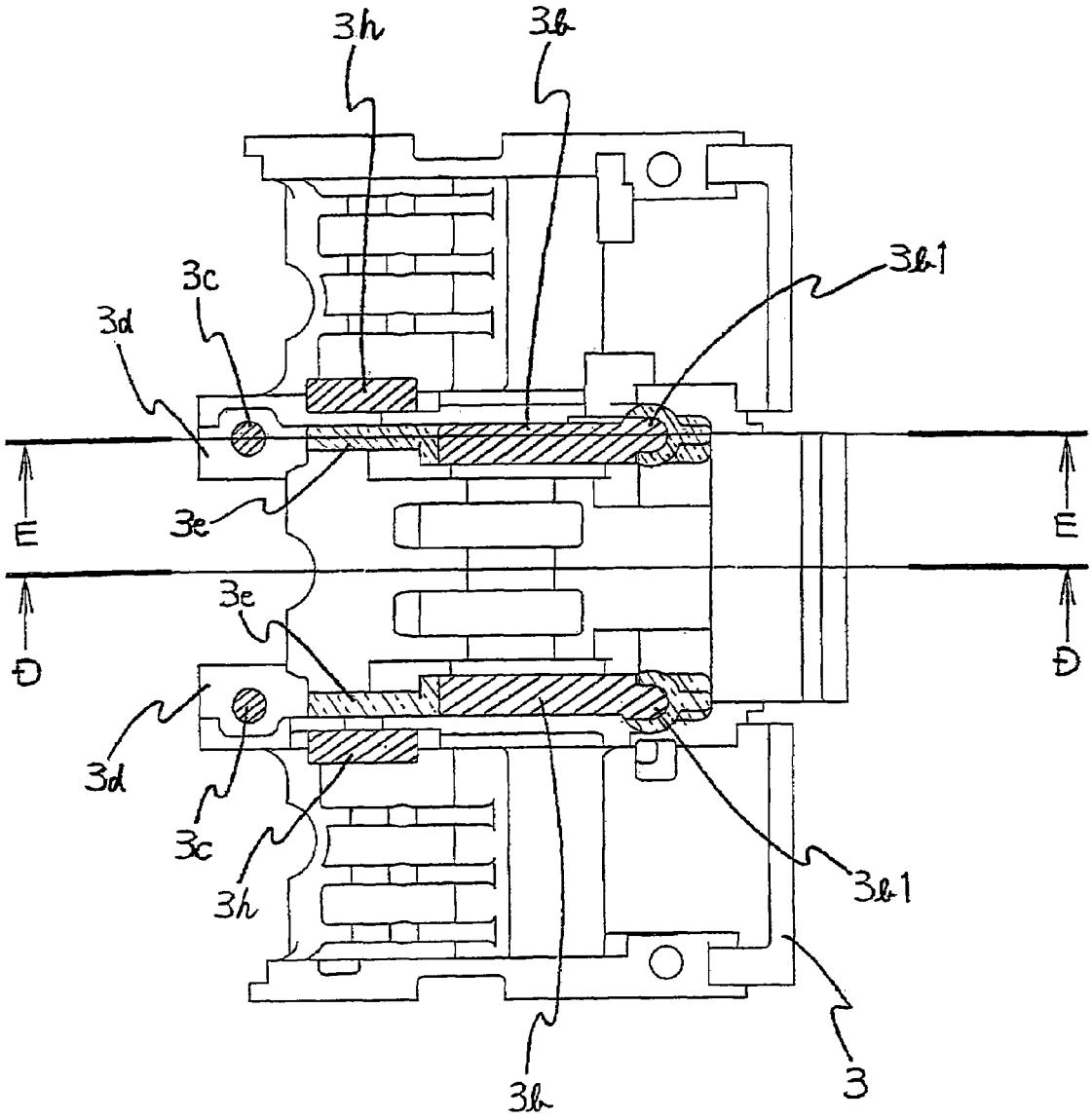
FIG. 3 is a view taken in a direction indicated-by the arrow B of a middle base in FIG. 1.
Figure 4:
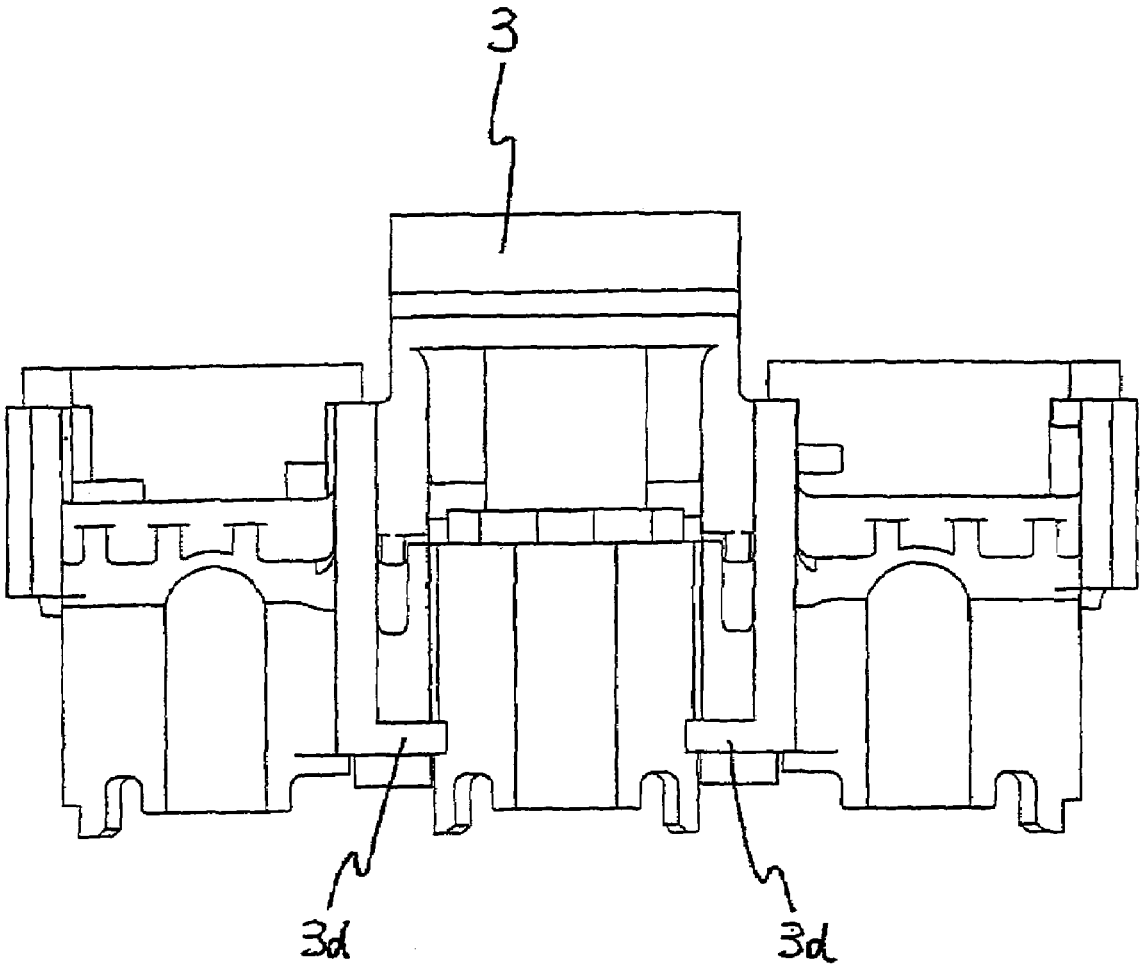
FIG. 4 is a view taken in a direction indicated by the arrow C of the middle base in FIG. 1.

A first preferred embodiment according to the present invention is hereinafter described referring to FIGS. 1 through 5. FIG. 1 is an exploded perspective view showing a state in which a circuit breaker according to the first embodiment of the invention is exploded in a vertical direction. FIG. 2 is a cross sectional view taken along the line A-A in FIG. 1. FIGS. 3 and 4 are enlarged views of a middle base in FIG. 1. FIG. 3 is a plan view taken in a direction indicated by the arrow B of FIG. 1, and FIG. 4 is a side view taken in a direction indicated by the arrow C. Further, FIGS. 5(*a*) and (*b*) are cross sectional views taken along the line D-D and the line E-E in FIG. 3 respectively.

FIG. 1 shows an example of a three-pole circuit breaker 101 having three voltage poles (hereinafter referred to as a circuit breaker). In the drawing, an insulating housing of the circuit breaker 101 is formed of three parts of a cover 2, a middle base 3, and a base 4. In the above-mentioned cover 2, there are formed a handle window hole 2*a* through which an operating handle 1 extends, and a setting part window hole 2*b* through which a setting part 103*a* functioning to set, e.g., instantaneous trip current values of the below-described over-current trip device 103 that is mounted on the base 4. On the above-mentioned middle base 3, there is mounted a make-and-break mechanism part 102 connected to the operating handle 1, and the above-mentioned make-and-break mechanism part 102 is separated from the below-described breaking portion 104.

In the above-mentioned base 4, there are fixed or disposed the over-current trip device 103 as described above, and other moving contact part 104 connected with a cross bar 5, fixed contact 6 (refer to FIG. 2), arc-extinguishing device 7 and so on. In addition, with the state (turning-on and resting position) of the moving contact 9 (refer to FIG. 2) and the operating handle 1, it is as known that the front (right side) is the side of a power supply, and the back (left side) is the load side in the plane of a paper. In the middle base 3 of these parts, to prevent the damage due to rise of an internal pressure caused by arc generated at the time of interruption, side plates 3*a* and 3*a* are made to fit into concave parts 4*a* and 4*a* of the base 4. Thus, these side plates 3*a* and 3*a* form a part of the base 4. Additionally, hatched parts show holes in the plan view of the middle base 3 shown in FIG. 3.

Now, the assembly procedures of this circuit breaker are described referring to FIG. 2. First, the fixed contact 6 is secured to the inner bottom face 4*b* of the base 4 with screws, not shown, and then a moving contact support 8 is also secured thereto with screws, not shown, along with the over-current trip device 103 in the state in which the moving contact 9 that is sandwiched between the moving contact supports 8 is connected in three poles with the cross bar 5 (corresponding to the above-described moving contact part 104). Subsequently, the arc-extinguishing device 7 is disposed in a predetermined position, and the middle base 3 is put on so as to cover the breaking portion 104. On this middle base 3, the make-and-break mechanism part 102 is mounted as described above. At this time, due to the fact that a lower link 10 of the make-and-break mechanism part 102 goes through a first hole 3*b* (refer to FIG. 3) of the middle base 3 and is coupled to a holding part 5*a* of the cross bar 5, the moving contact part 104 is turned as the operating handle 1 is turned, that is, the circuit breaker 101 is brought in an open circuit or a closed circuit. Therefore, these first holes 3*b* and 3*b* are slot-shaped conforming to the turning range of the lower links 10 and 10.

Frame plates 11 of the make-and-break mechanism part 102 are in opposition to each other (refer to FIG. 1), whereby the make-and-break mechanism part 102 is formed as a unit. This unit of make-and-break mechanism part. 102 is secured by means of screws, not shown, from underside of the base 4 to pairs of threaded parts 11*a*, 11*b*, 11*a*, 11*b* (refer to FIG. 1) disposed at both ends (front and rear ends) of the frame plates 11 respectively. At this time, the screws of the threaded parts 11*a* and 11*a* go through second holes 3*c* and 3*c* of the middle base 3 (refer to FIG. 3), and the screws of the threaded parts 11*b* and 11*b* go through recesses 3*b*1 and 3*b*1 (refer to FIG. 3) that are extended on the right-hand side in the plane of a paper of the first holes 3*b* and 3*b* respectively. Since bases 3*d* and 3*d* in which the second holes 3*c* and 3*c* are formed are brought in contact with the inner bottom face 4*b* of the base 4, the middle base 3 is also secured thereto. Finally, the cover 2 is put on eventually forming a breaker 101.

Figure 5:
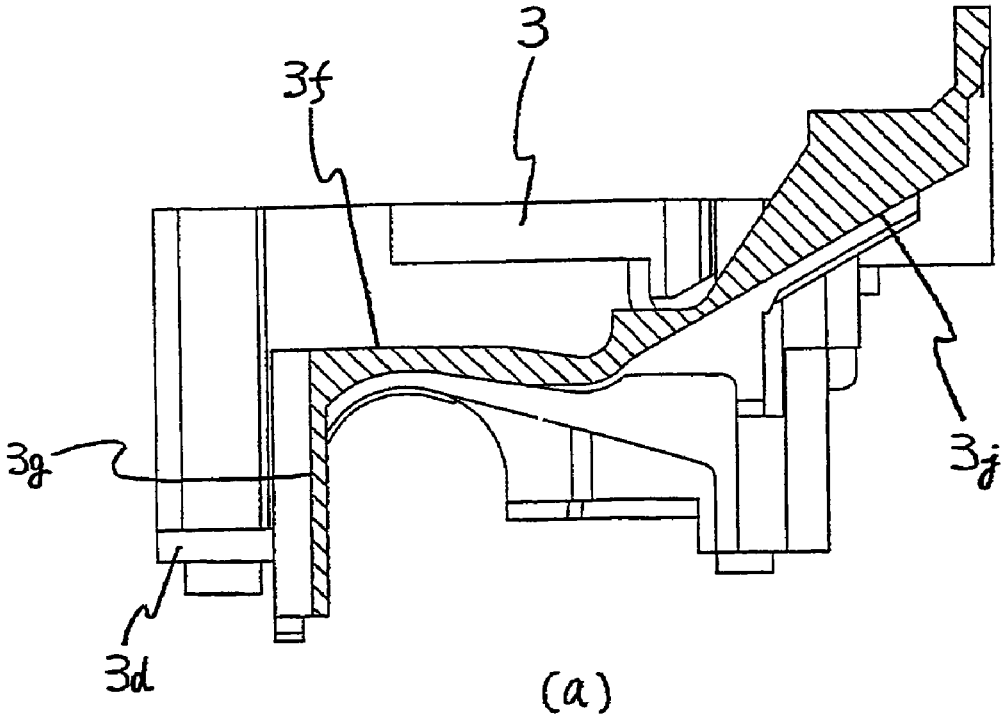
FIGS. 5(*a*) and (*b*) are cross sectional views taken along the line D-D and the line E-E in FIG. 3 respectively.
Figure 5:
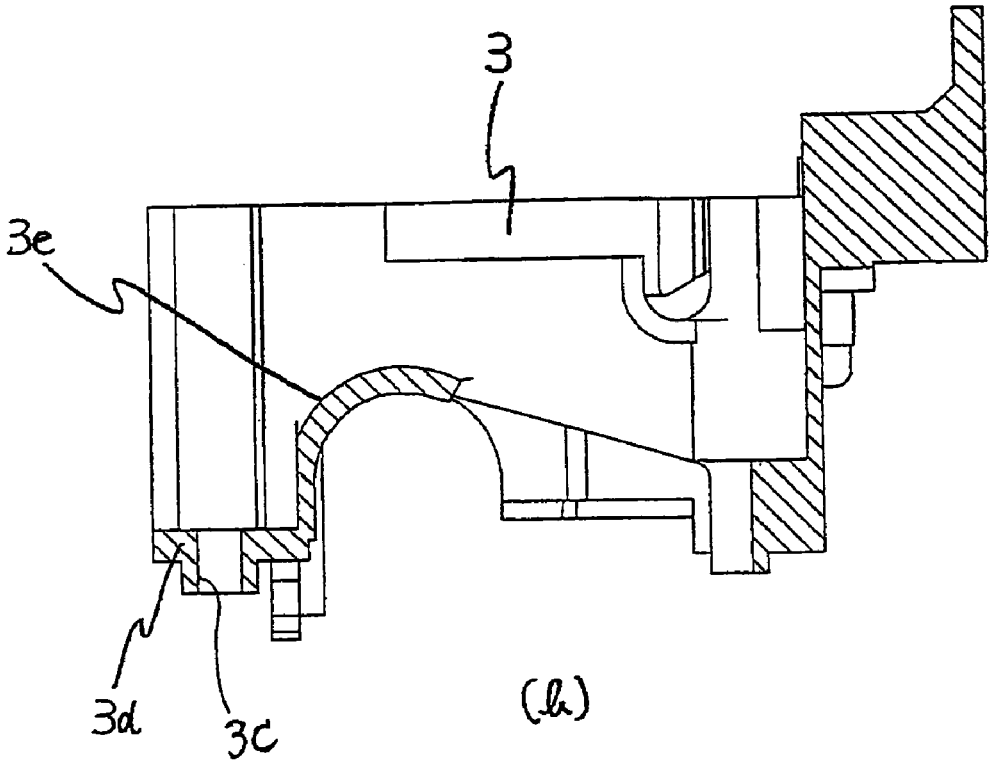

Since the above-described fastening of the make-and-break mechanism part 102 forms an essential part of the invention, the detailed description thereof will be hereinafter made. With reference to FIG. 3, grooves 3*e* and 3*e* (alternate long and short dashed line part) are formed from the bases 3*d* and 3*d* to the first holes 3*b* and 3*b* on the line connecting the first holes 3*b* and 3*b* and the second holes 3*c* and 3*c* of the middle base 3 (one-dot-chain line). These grooves 3*e* and 3*e*, as shown in FIG. 5(*b*), are in conformity with the shape of the frame plates 11 notched in a substantially half circle (refer to FIG. 2) corresponding to the cross bar 5 being turned. That is, the semi-circular notch of the frame 11 will be in contact along the upper portion of the above-mentioned groove 3*e*.

Thus, it will be shown that as compared with this substantially semi-circular portion or the threaded part 11*b* (refer to FIG. 2), the threaded part 11*a* (refer to FIG. 2) is in the proximity of the inner bottom face 4*b* of the base 4. This fact will be understood from that the base 3*d* of the middle base 3 is disposed at a position near the lowermost end in a vertical direction on the plane of a drawing paper. That is, in the case of a comparatively small rated breaking current, the above-mentioned middle base 3 is removed, and alternatively, for example, a resin spacer is interposed instead of the base 3*d*, i.e., the middle base 3, thereby enabling the make-and-break mechanism part 102 to be secured without any change in layout or part structure of the breaking portion, the make-and-break mechanism part 102 and the over-current trip device 103, etc.

Figure 6:
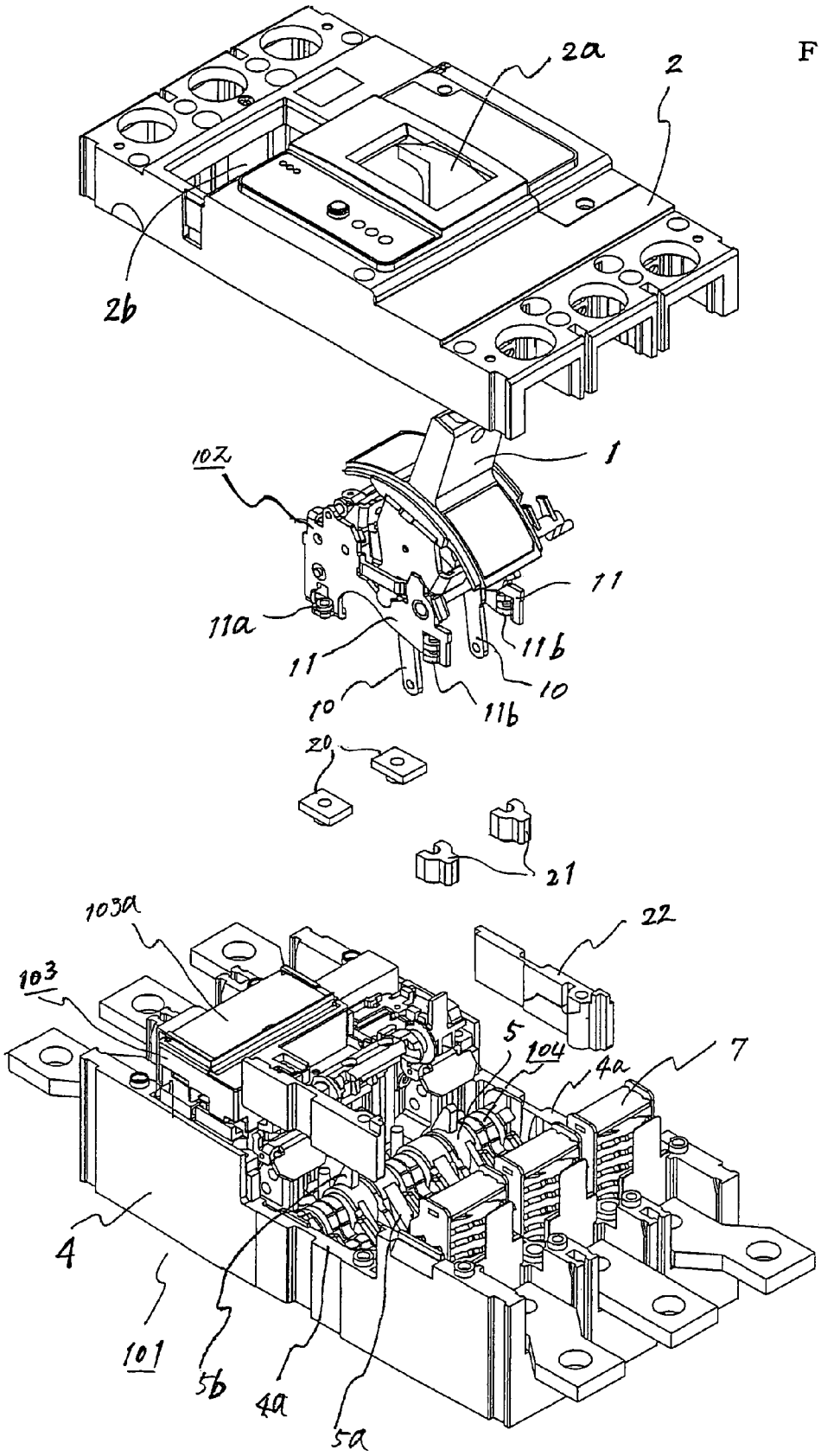
FIG. 6 is an exploded perspective view of a circuit breaker when the middle base is detached.

FIG. 6 is an exploded perspective view of a circuit breaker when a middle base 3 is removed, and corresponds to FIG. 1 of when the middle base 3 is attached. In the drawing, the same reference numerals indicate the same or like parts as FIG. 1. In the drawing, numeral 20 designates spacers that are inserted between the threaded part 11*a* of the make-and-break mechanism part 102 and the bottom of the base 4, and secured with screws, not shown, from underside of the base 4. Numeral 21 designates spacers that are inserted between the threaded part 11*b* of the make-and-break mechanism part 102 and the bottom of the base 4, and secured with screws, not shown, from underside of the base 4. Further, a numeral 22 designates a part corresponding to a side plate 3*a* of the middle base 3. Accordingly, also in the case where the middle base 3 is removed, it is possible to obtain a circuit breaker in which the above-mentioned breaking portion, make-and-break mechanism part, and over-current trip device are not separated from each other without any change in layout and part structure of these parts.

In general, a circuit breaker is more likely to be inexpensive as a rated breaking current thereof is smaller. Accordingly, each manufacturer is required to reduce the manufacturing cost of products of small rated breaking current. In this regard, since the invention does not place much importance on the advantages of mounting any middle base 3 in the case of a small rated breaking current, this comparatively expensive middle base 3 is not necessarily used, and a unit of make-and-break mechanism part 102 can also be used in a shared manner, thus enabling to obtain a circuit breaker of a manufacturing cost for a reasonable price. Although unemployment of a middle base 3 leads to the necessity of mounting such parts as the above-described spacers or side plates 3*a* and 3*a* (refer to FIG. 1), it is apparent that the addition of these parts gives no influence on manufacturing cost of this circuit breaker.

Advantages of mounting a middle base 3 are hereinafter described. As shown in FIG. 5(*a*), the middle base 3 is provided with a horizontal part 3*f* and a vertical part 3*g* functioning as a partition wall. Therefore, the breaking portion that is formed of the cross bar 5, the fixed contact 6, the arc-extinguishing device 7 and the moving contact 9 is separated from the make-and-break mechanism part 102 with the horizontal part 3*f*; and the above-mentioned breaking portion is separated from the over-current trip device 103 with the vertical part 3*g*. Thus, in the same manner as in the case of the Japanese Patent Publication (unexamined) No. 228669/2005, it is possible to protect the make-and-break mechanism part 102 and the over-current trip device 103 from the arc, hot air, molten material or soot that is generated from the breaking portion at the time of breaking.

Figure 7:
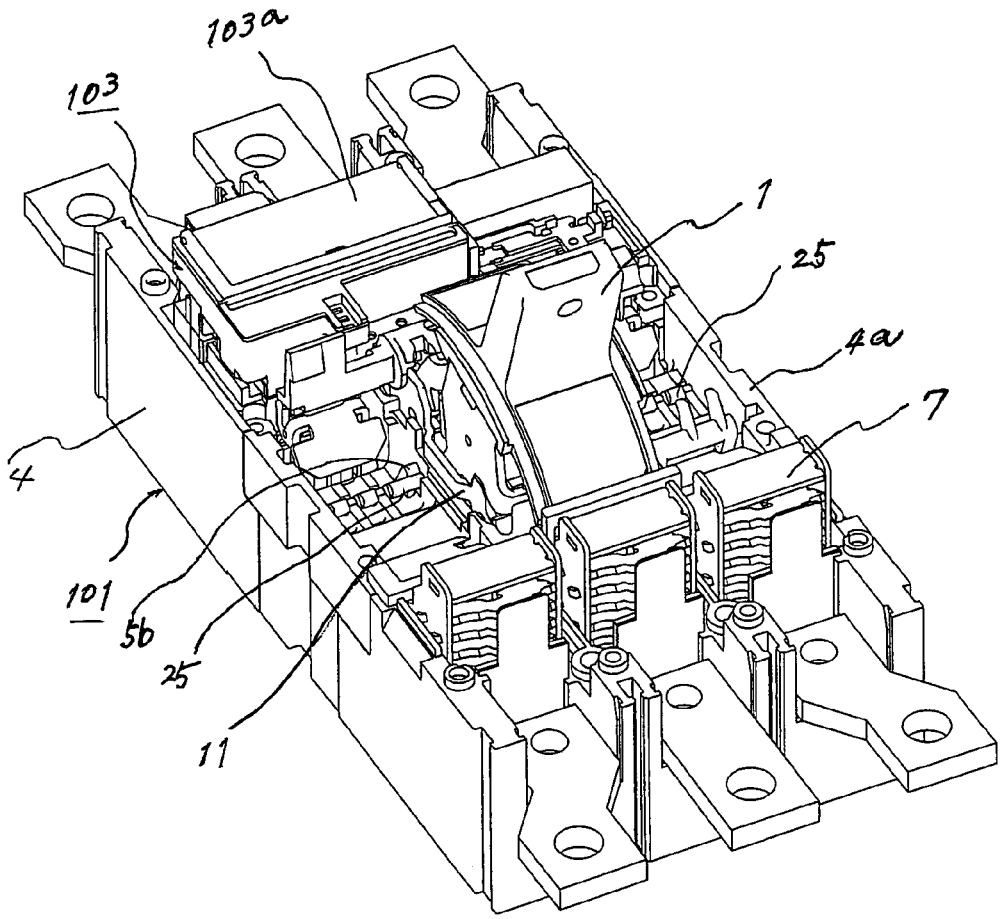
FIG. 7 is a perspective view showing a circuit breaker after assembly.

In addition, the horizontal part 3*f* is provided with a third hole 3*h* are slot-shaped conforming to the turning range of a protrusion 5*b* of the cross bar 5. Thus, it is possible to know a state of the cross bar 5, that is, a position of the moving contact 9 from outside of the middle base 3 with the protrusions 5*b*, so that, for example, engagement of these protrusions 5*b* with actuators acting as an auxiliary contact makes it possible to transmit the state of contact of a circuit breaker 101 to outside of this circuit breaker as electric signals. FIG. 7 is a perspective view showing a circuit breaker after assembly. In the drawing, reference numeral 25 designates an actuator. Moreover, although any auxiliary contact is not shown, normally it is constructed such that micro switches are mounted in the space above the mentioned actuators 25, and buttons of the micro switches are engaged with the actuators 25.

Further, to achieve reliable positioning of the circuit breaker 101 and to prevent the dislocation of the circuit breaker 101 due to vibration or impact, it is preferable that an arc-extinguishing device holding part 3*i* (refer to FIG. 1) is provided at a position opposite to the above-mentioned arc-extinguishing device 7 of the middle base 3. Furthermore, to absorb an impact when the moving contact 9 is separated, it is more preferable that a stopper 3*j* (refer to FIG. 5(*a*)) is provided at a position opposite to the moving contact 9 of the middle base 3. In addition, the material of a middle base 3 is not necessarily the same as that of a cover 2 or a base 4. It is preferable to select any economical material, considering the function as the above-described partition wall or the function of absorbing impact.

Embodiment 2

Figure 8:
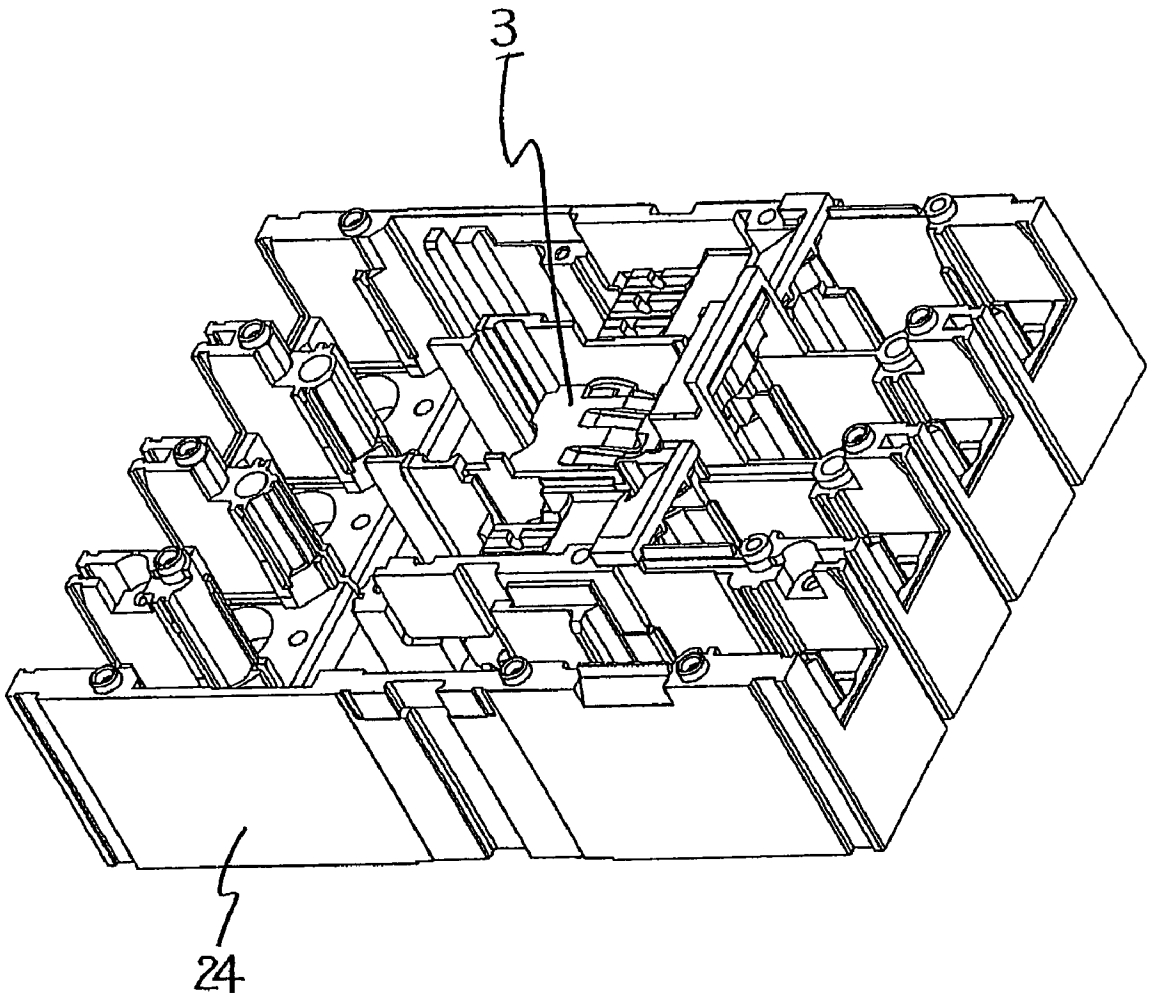
FIG. 8 is an external perspective view of a base and a middle base according to a second embodiment of the invention.

According to the foregoing first embodiment, a three-pole circuit breaker is described as an example. However, an electric circuit is not limited to the three-pole type, and there is the one having voltage poles and a neutral pole, that is, a four-pole circuit breaker. In this second embodiment, a middle base 3 is applied to this four-pole circuit breaker, and is now described referring to FIG. 8. FIG. 8 is an external perspective view showing a state in which the middle base 3 is integrated into a base 24 of a four-pole circuit breaker according to the second embodiment of the invention.

In the case of a four-pole circuit breaker, typically a base and a cover are for exclusive use in the four-pole circuit breaker. The advantage of the middle base 3 as described in the first embodiment, that is, the prevention of adherence of molten material to the sliding parts is to be performed focusing attention only on voltage poles in this four-pole circuit breaker. Thus, as shown in FIG. 8, the configuration of the four-pole base 24, particularly the phase-to-phase configuration between voltage poles and a neutral pole may be determined so that a middle base 3 having been described in the first embodiment (i.e. three-pole middle base 3) can be mounted onto the four-pole base 24.

As a result of such arrangement, not only a make-and-break mechanism part 102 but also a middle base 3 can be shared, so that it is possible to improve more standardization of parts.

Further, according to the above-mentioned embodiments, although examples in which the make-and-break mechanism part 102 is provided with pairs of threaded parts 11*a*, 11*b*, 11*a*, 11*b* at both ends (front and back ends) of frame plates 11 respectively, and secured thereto with screws from the underside of a base 4 are described. However, it is not limited to the threaded mounting, and any other alternative fastening means may be employed as a matter of course.

While the presently preferred embodiments of the present invention have been shown and described. It is to be understood that these disclosures are for the purpose of illustration and that various changes and modifications may be made without departing from the scope of the invention as set forth in the appended claims.

What is claimed is:

1. A circuit breaker comprising:

a make-and-break mechanism part that includes an operating handle, and is disposed between frame plates opposite to each other;

a base having a cross bar that turns in cooperation with said make-and-break mechanism part, a moving contact that cooperates with said cross bar, a fixed contact that repeats the contact and separation from said moving contact, a breaking portion including an arc-extinguishing device functioning to extinguish arc generated between said moving contact and said fixed contact, and an over-current trip device;

a middle base in which a partition wall serving to separate said breaking portion from said make-and-break mechanism part, and said breaking portion from said over-current trip device, is provided; and in which said make-and-break mechanism part is contained; and a cover with which said base, middle base and each of parts contained in said base and middle base are covered;

wherein said frame plates of said make-and-break mechanism part are secured to said base when said middle base is provided in said circuit breaker and are secured to said base through spacers when said middle base is removed from said circuit breaker.

2. The circuit breaker according to claim 1, wherein said frame plate is provided with pairs of threaded parts to be secured by means of screws through the middle base from the underside of said base respectively; and a base part of said middle base is in contact with the inner bottom face of the base.

3. The circuit breaker according to claim 1, wherein said middle base is provided with a first hole through which a lower link of said make-and-break mechanism part goes to be coupled to the cross bar, and a second hole formed in a base part; and said first hole is slot-shaped conforming to the turning range of said lower link when make-and-break of said both of the contacts is made with said operating handle being turned.

4. The circuit breaker according to claim 1, wherein the partition wall of said middle base consists of a horizontal part to separate said breaking portion from the make-and-break mechanism part, and a vertical part to separate said breaking portion from the over-current trip device.

5. The circuit breaker according to claim 4, wherein said middle base is further provided with a third hole, which is formed on said partition wall of said horizontal part, and through which a protrusion that is formed at said cross bar goes; and said third hole is slot-shaped conforming to the turning range of the cross bar.

6. The circuit breaker according to claim 1, wherein side plates that are provided at two side faces of the middle base in parallel with an electric circuit direction of said circuit breaker are fit into concave portions formed in the base, whereby said middle base forms a part of an insulating housing of said circuit breaker.

7. The circuit breaker according to claim 1, wherein an arc-extinguishing device holding part is provided at a position opposite to said arc-extinguishing device of the middle base.

8. The circuit breaker according to claim 1, wherein a stopper is provided at a position opposite to said moving contact of the middle base.

9. The circuit breaker according to claim 1, wherein a threaded part of said frame plate and a bottom of said base are directly secured with screws via a said spacers when said middle base is removed.

10. The circuit breaker according to claim 1, wherein in case of forming a four-pole circuit breaker having three voltage poles and one neutral pole, said middle base is mounted onto said voltage poles.

* * * * *